US006123556A

United States Patent [19]

Asakura et al.

[11] Patent Number: 6,123,556

[45] Date of Patent: Sep. 26, 2000

[54] SHIELDED CABLE CONNECTION STRUCTURE AND PROCESSING METHOD

[75] Inventors: Nobuyuki Asakura; Yasumichi Kuwayama; Tetsuro Ide, all of Shizuoka-ken, Japan

[73] Assignee: Yazaki Corporation, Tokyo, Japan

[21] Appl. No.: 09/140,555

[22] Filed: Aug. 26, 1998

[30] Foreign Application Priority Data

Aug. 29, 1997 [JP] Japan ..... 9-234888

[51] Int. Cl.[7] ..... H01R 4/66

[52] U.S. Cl. ..... 439/99; 29/828; 29/863; 439/874

[58] Field of Search ..... 439/98, 99, 874, 439/578, 610; 29/828, 860, 863, 857

[56] References Cited

U.S. PATENT DOCUMENTS 3,717,842 2/1973 Dpuglas, Jr. ..... 29/860
5,163,856 11/1992 McGaffigan et al. ..... 439/874
5,547,395 8/1996 Delamotte ..... 439/578
5,888,095 3/1999 Hussaini ..... 439/578

FOREIGN PATENT DOCUMENTS 8-78071 3/1996 Japan .
2211367 6/1989 United Kingdom .

OTHER PUBLICATIONS

Nov. 23, 1998 Great Britain Search Report.

*Primary Examiner*—Renee S. Luebke
*Assistant Examiner*—Javaid Nasri
*Attorney, Agent, or Firm*—Finnegan, Henderson, Farabow, Garrett & Dunner, L.L.P.

[57] ABSTRACT

One side of a shielded terminal coated with a low-melting-point conductive coupling material is inserted between an outer insulating cover and a braided wire or between an inner insulating cover and the braided wire, and with one side of the shielded terminal inserted, ultrasonic vibrations are applied from above the outer insulating cover, so that the low-melting-point coupling material is molten and one side of the shielded terminal and the braided wire are conductively connected to each other, forming a shielded conductor.

11 Claims, 9 Drawing Sheets

SHIELDED CABLE CONNECTION STRUCTURE AND PROCESSING METHOD

BACKGROUND OF THE INVENTION

1. Field of the Invention

The present invention relates to a connection structure for and a processing method of connecting a braided wire of a shield cable and a shielded terminal.

2. Description of the Related Art

As shown in FIGS. 1 and 2, there has been disclosed in Japanese Patent Application Laid-Open Publication No. 8-78071 a conventional connection structure of a shielded cable. This connection structure is for establishing a connection by stripping a shielded cable 1. After an outer insulating cover 2 is stripped off to expose a braided wire 3, the braided wire 3 is folded back in two layers toward the outer insulating cover 2. After that, an inner insulating cover 4 is stripped off to expose a core 5.

The shielded cable 1 thus processed has the inner insulating cover 4 applied through a terminal holder 6, and the holder 6 is clamped. The shielded cable 1 is thus fixed on a terminal 7 through the inner insulating cover 4. At the same time, a connector 8 of the terminal 7 is clamped to connect a core 5 to the terminal 7. Under this condition, the terminal 7 is applied through a cylindrical shielded terminal 9 and connected to the braided wire 3 in the shielded terminal 9.

For connecting the shielded terminal 9 and the braided wire 3, as shown in FIG. 2, a bent spring plate 10 is arranged in the shielded terminal 9, and brought into conductive contact with the braided wire 3. In FIGS. 1 and 2, designated at reference character 11 is a housing in which the shielded terminal 9 and the terminal 7 are inserted, and 12 is a cap fitted in an opening end 9*a* of the shielded terminal 9.

With this connection structure, the braided wire 3 is not required to be exposed long, and the work of twisting the braided wire 3, applying it through a heat-contracting tube and connecting by clamping the shielded terminal 9 to the braided wire 3 is eliminated for an improved connection workability.

In the above-mentioned conventional connection structure, however, it is necessary to strip off the outer insulating cover of the shielded cable 1 to expose the braided wire 3 for connecting the shielded cable 1 to the shielded terminal 9. The stripping process is troublesome and time consuming.

Also, the spring plate 10 must be arranged in the shielded terminal 9 for connection. This complicates the structure of the shielded terminal 9 and makes the manufacture thereof troublesome.

Further, in order to assure sufficient contact between the spring plate 10 and the braided wire 3, a large spring load of the spring plate 10 is required. In the case where the spring load is increased more than necessary, however, insertion of the braided wire 3 in the spring plate 10 becomes difficult. Also, a large spring load causes the spring plate 10 to pull the braided wire 3 as shown in FIG. 3, thereby leading to the problem of the spring plate 10 not being kept in sufficient contact with the braided wire 3.

SUMMARY OF THE INVENTION

The present invention has been achieved with such points in view.

It therefore is an object of the present invention to provide a connection structure and a method of processing a shielded cable in which the troublesome stripping work is eliminated to assure a shorter connection process, the structure of the shielded terminal is simplified, and the shielded cable can be easily connected to the shielded terminal, with a secured conduction.

To achieve the object, a first aspect of the invention provides a connection structure for connecting a shielded terminal to a braided wire of a shielded cable including a core made of a conductor, an inner insulating cover covering the core, the braided wire arranged around the inner insulating cover, and an outer insulating cover made of resin arranged around the braided wire for covering the core, the inner insulating cover and the braided wire, wherein one side of the shielded terminal coated with a conductive coupling material of a low melting point is inserted between the outer insulating cover and the braided wire or between the inner insulating cover and the braided wire, and under this condition, the coupling material is molten by applying ultrasonic vibrations from above the outer insulating cover, thereby forming a shielded conductor with one side of the shielded terminal conductively connected to the braided wire.

In this shielded cable connection structure, one side of the shielded terminal coated with the low-melting-point conductive coupling material is inserted between the outer insulating cover and the braided wire or between the inner insulating cover and the braided wire, and under this condition, ultrasonic vibrations are applied from above the outer insulating cover. The ultrasonic vibrations applied from above the outer insulating cover generate internal heat due to ultrasonic energy, so that the low-melting-point conductive coupling material is molten for coupling the braided wire metallurgically. This coupling causes the braided wire to be electrically connected with the shielded terminal.

This is not a typical mechanical contact but an electrical connection due to the coupling by a melting of a low-melting-point coupling material, and gives rise to a high reliability.

Since the work of stripping off to expose the braided wire is not required, the braided wire of the shielded cable can be easily connected with the shielded terminal for a reduced number of jobs and an improved workability.

Further, the structure of the shielded terminal is simplified as it is so shaped as to be insertable between the outer insulating cover and the braided wire or between the inner insulating cover and the braided wire of the shielded cable.

According to a second aspect of the invention, ultrasonic vibrations are applied with at least a resin chip arranged between the outer insulating cover and an ultrasonic hone for applying ultrasonic vibrations while the resin chip is embedded in the outer insulating cover.

In this shielded cable connection structure, application of ultrasonic vibrations from above the resin chip melts the low-melting-point coupling material and electrically connects the braided wire to one side of the shielded terminal while the resin chip is embedded in the outer insulating cover.

In this case, unless the resin chip is arranged between the outer insulating cover and the ultrasonic hone, the outer insulating cover is dented by the ultrasonic vibrations of the ultrasonic hone. In the presence of the resin chip between the ultrasonic hone and the outer insulating cover, however, the resin chip is embedded in the outer insulating cover under the ultrasonic vibrations, and therefore the dent is hidden for an improved outer appearance of the shielded cable.

According to a third aspect of the invention, one side of the shielded terminal is inserted between the outer insulating cover and the braided wire or between the inner insulating cover and the braided wire from the flush cut surface side of the shielded cable where at least the outer insulating cover and the braided wire are cut flush with each other.

In this shielded cable connection structure, one side of the shielded terminal is inserted between the outer insulating cover and the braided wire or between the inner insulating cover and the braided wire from the flush cut surface side constituting a cut end surface of the shielded cable and ultrasonic vibrations are applied from above the outer insulating cover. The ultrasonic vibrations thus applied melts the low-melting-point coupling material and thus electrically connects the braided wire and one side of the shielded terminal to each other.

According to the third aspect, in processing the end portion of the shielded cable, the shielded terminal and the braided wire can be connected to each other with the shielded cable cut off to assure the braided wire and the outer insulating cover flush with each other. Therefore, unlike the prior art, the work of stripping off the outer insulating cover is eliminated, thereby facilitating the work of processing the end portion of the shielded cable.

According to a fourth aspect of the invention, the shielded terminal includes a cylindrical terminal body and an insertion connection end arranged on one side of the terminal body and adapted to be inserted into the flush-cut surface side of the shielded cable, in which a terminal fitting connected to the core of the shielded cable is accommodated in the terminal body of the shielded terminal with the insertion connection end inserted into the flush-cut surface.

In this connection structure of the shielded cable, the terminal fitting connected to the core of the shielded cable is accommodated in the terminal body with the insertion connection end inserted between the outer insulating cover and the braided wire or between the inner insulating cover and the braided wire from the flush-cut surface side. This facilitates the processing work at the end portion of the shielded cable.

According to a fifth aspect of the invention, a slit is formed in the outer insulating cover of the shielded cable, and one side of the shielded terminal is inserted through this slit between the braided wire and the outer insulating cover.

In this shielded cable connection structure, a slit is formed in the outer insulating cover, and one side of the shielded terminal is inserted between the outer insulating cover and the braided wire from this slit. Then, ultrasonic vibrations are exerted, so that the low-melting-point coupling material is molten thereby to conductively connect the one side of the shielded cable and the braided wire to each other. This connection structure permits one side of the shielded cable and the braided wire to be electrically connected to each other at an arbitrary axial position of the shielded cable and also to be grounded at an arbitrary position taking the profile of the shielded terminal into consideration.

According to a sixth aspect of the invention, the shielded terminal includes a tabular terminal body, an insertion connection end arranged on one side of the terminal body for insertion between the outer insulating cover and the braided wire from the slit of the shielded cable and a grounding terminal arranged on the other side of the terminal body.

In this shielded cable connection structure, the insertion connection end is inserted between the outer insulating cover and the braided wire from the slit formed in the outer insulating cover, and the low-melting-point coupling material is molten by ultrasonic vibrations, thereby conductively connecting one side of the shielded terminal and the braided wire to each other. This connection structure is so simple that it has only the insertion connection end formed on one side of the shielded terminal.

According to a seventh aspect of the invention, the ultrasonic hone for ultrasonic vibrations has at least the central portion thereof out of contact with the outer insulating cover.

In this shielded cable connection structure, the ultrasonic hone for applying ultrasonic vibrations has at least the central portion thereof opposed to and out of contact with the outer insulating cover. Therefore, the low-melting-point coupling material that has been molten by the internal heat generated by the ultrasonic energy due to the ultrasonic vibrations is less scattered to other than the contact between one side of the shielded terminal and the braided wire, and thus can be efficiently molten at the contact between one side of the shielded terminal and the braided wire.

According to an eighth aspect of the invention, there is provided a method of processing a shielded cable comprising a core made of a conductor, an inner insulating cover for covering the core, a braided wire arranged around the inner insulating cover, and an outer insulating cover of resin arranged around the braided wire for covering the core, the inner insulating cover and the braided wire, wherein one side of the shielded terminal coated with a low-melting-point conductive coupling material is inserted between the outer insulating cover and the braided wire or between the inner insulating cover and the braided wire, and wherein ultrasonic vibrations are applied from above the outer insulating cover so that the low-melting-point coupling material is molten thereby to conductively connect one side of the shielded terminal and the braided wire to each other.

In this method of processing a shielded cable, ultrasonic vibrations are applied from above the outer insulating cover with one side of the shielded terminal inserted between the outer insulating cover and the braided wire or between the inner insulating cover and the braided wire. The ultrasonic vibrations applied from above the outer insulating cover melt the low-melting-point coupling material coated on one side of the shielded terminal and conductively connects the one side of the shielded terminal and the braided wire to each other.

This is not a typical mechanical connection but a highly reliable electrical connection due to the coupling by the fusion of a low-melting-point coupling material. Also, since the stripping work for exposing the braided wire is not required, the braided wire of the shielded cable and the shielded terminal can be easily connected to each other for a reduced number of working steps and an improved workability. Further, the shielded terminal can be inserted between the outer insulating cover and the braided wire or between the inner insulating cover and the braided wire of the shielded cable and is so simple in structure.

According to a ninth aspect of the invention, at least a resin chip is arranged between an ultrasonic hone for applying ultrasonic vibrations and the outer insulating cover, and ultrasonic vibrations are applied through the resin chip which is embedded in the outer insulating cover.

In this method of processing a shielded cable, ultrasonic vibrations applied from above the resin chip by the ultrasonic hone melt a low-melting-point coupling material so that the braided wire and one side of the shielded terminal are electrically connected to each other while the resin chip is embedded in the outer insulating cover at the same time.

As a result, the dent formed in the outer insulating cover under the ultrasonic vibrations by the ultrasonic hone is embedded in the resin chip. The dent is thus hidden and the appearance of the shielded cable is improved.

According to a tenth aspect of the invention, one side of the shielded terminal is inserted between the outer insulating cover and the braided wire or between the inner insulating cover and the braided wire from a flush-cut surface side of the shielded cable where at least the outer insulating cover and the braided wire are cut flush to each other.

In this method of processing a shielded cable, one side of the shielded terminal is inserted between the outer insulating cover and the braided wire or between the inner insulating cover and the braided wire from the flush-cut surface side constituting a cut end surface of the shielded cable, and ultrasonic vibrations are applied from above the outer insulating cover. As a result, the low-melting-point coupling material is molten so that the braided wire and one side of the shielded terminal are electrically connected to each other.

According to the tenth aspect, the work of stripping off the outer insulating cover is eliminated from the work of processing an end portion of the shielded cable, in view of the fact that the shielded terminal and the braided wire can be connected to each other with the shielded cable cut in such a manner as to assure the core, the inner insulating cover, the braided wire and the outer insulating cover flush with each other. The work of processing the end of the shielded cable can thus be facilitated.

According to an eleventh aspect of the invention, one side of the shielded terminal is inserted between the outer insulating cover and the braided wire or between inner insulating cover and the braided wire from a slit formed in the outer insulating cover.

In this method of processing a shielded cable, a slit is formed in the outer insulating cover, one side of the shielded terminal is inserted between the outer insulating cover and the braided wire from this slit and is subjected to ultrasonic vibrations. As a result, the low-melting-point coupling material is molten so that one side of the shielded terminal and the braided wire are conductively connected to each other. With this connection structure, one side of the shielded terminal and the braided wire can be electrically connected at an arbitrary axial position of the shielded cable.

BRIEF DESCRIPTION OF THE ACCOMPANYING DRAWINGS

The above and further objects and novel features of the present invention will more fully appear from the following detailed description when the same is read in conjunction with the accompanying drawings, in which.

Figure 12A:
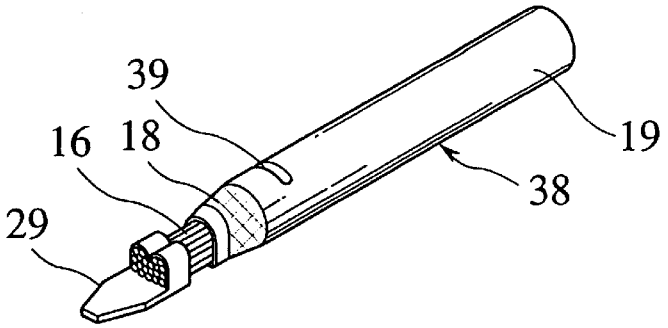
Figure 12B:
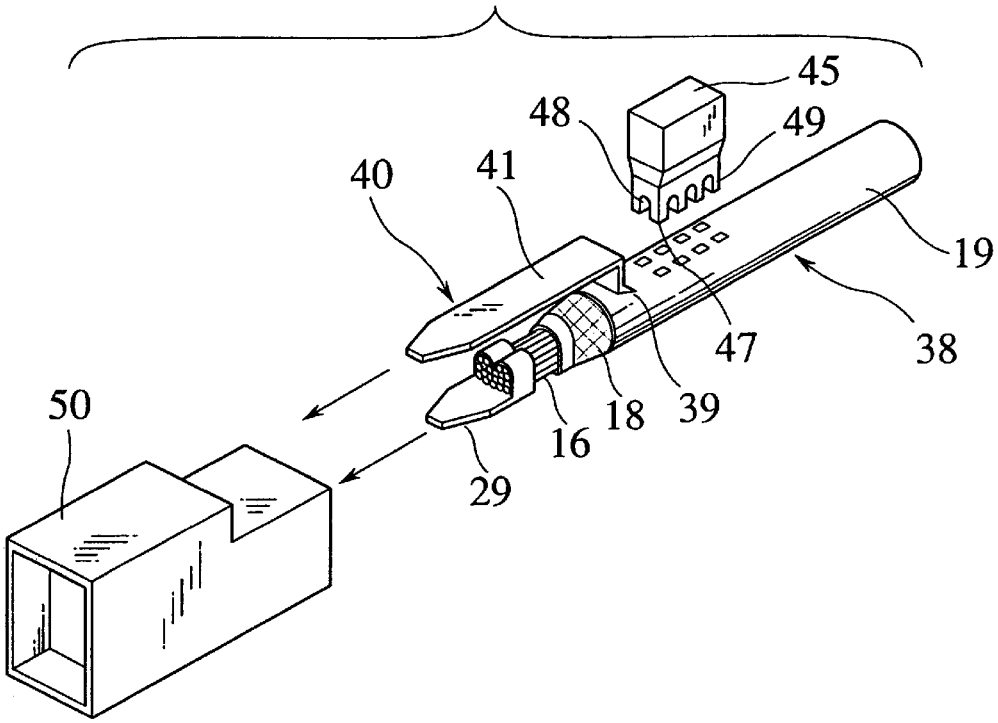
Figure 12C:
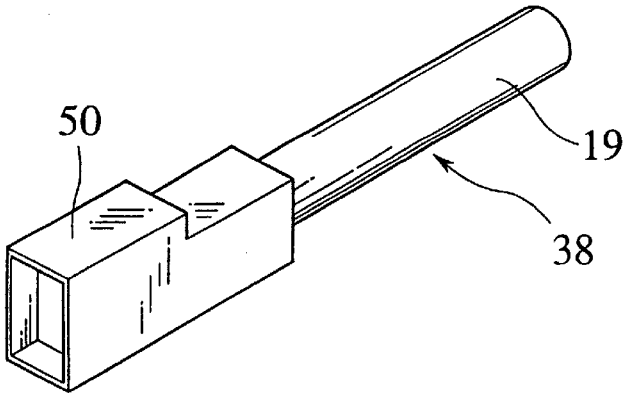

FIGS. 12A to 12C show the processing steps of the second embodiment, in which FIG. 12A is a perspective view of a shielded cable formed with a slit, FIG. 12B is a perspective view showing the manner in which ultrasonic vibrations are applied with the shielded terminal inserted between the outer insulating cover and the braided wire by way of the slit, and FIG. 12C is a perspective view showing the manner in which a shielded terminal and a terminal fitting are accommodated in a connector housing.

Figure 13:
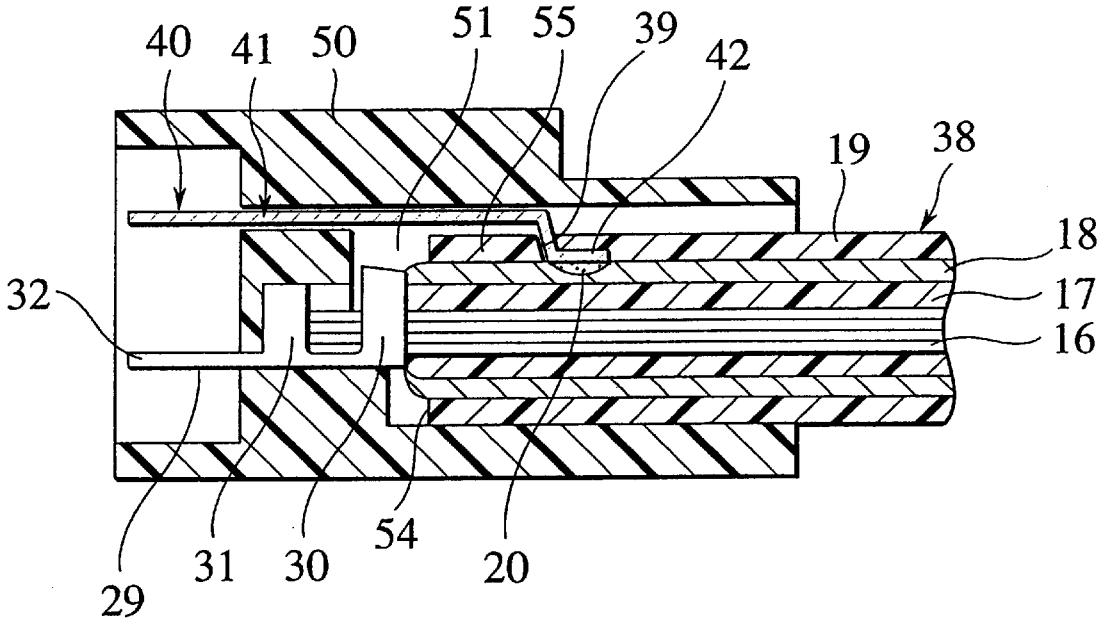
Figure 14:
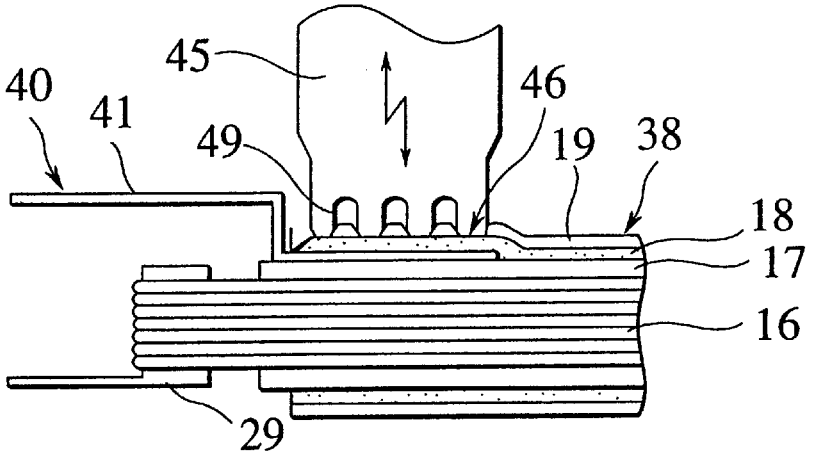
Figure 15:
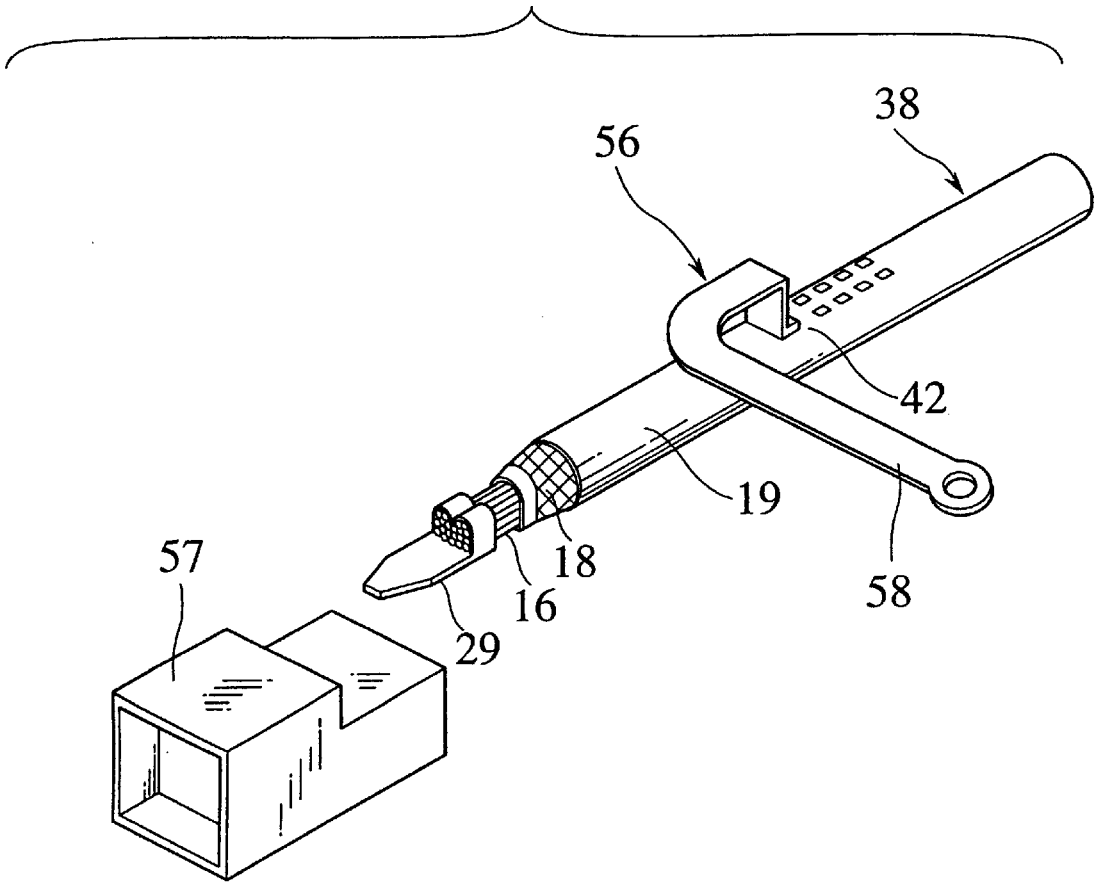

FIG. 13 is a sectional view showing the manner in which an end portion of the shielded cable is accommodated in the connector housing according to the second embodiment;

FIG. 14 is a diagram for explaining the effects of the second embodiment and a sectional view showing the manner in which a slit is formed at a position nearer to an end of the shielded cable; and FIG. 15 is a perspective view showing the manner in which the shielded terminal and the braided wire are connected to each other at an arbitrary axial position on the shielded cable according to a modification of the second embodiment.

DETAILED DESCRIPTION OF THE PREFERRED EMBODIMENTS

There will be detailed below the preferred embodiments of the present invention with reference to the accompanying drawings. Like members are designated by like reference character.

First embodiment

As shown in FIGS. 4A, 4B, 5, 6, a shielded cable 15 used in an embodiment includes a core 16 made of a conductor, an inner insulating cover 17 covering the core 16, a braided wire 18 arranged around the inner insulating cover 17, and an outer insulating cover 19 of resin arranged around the braided wire 18 for covering the core 16, the inner insulating cover 17 and the braided wire 18.

Also, in the connection structure according to this embodiment, one side of a shielded terminal 21 coated with a low-melting-point conductive coupling material 20 is inserted between the outer insulating cover 19 and the braided wire 18, and under this condition, the low-melting-point conductive material 20 is molten by ultrasonic vibrations applied from above the outer insulating cover 19, thereby forming a shielded conductor 22 with one side of the shielded terminal 21 and braided wire 18 conductively connected to each other.

The shielded terminal 21 includes a cylindrical terminal body 23, an insertion connection end 25 arranged on one side of the terminal body 23 and inserted in a flush-cut surface 24 side of the shielded cable 15, and a grounding terminal 26 arranged on the other side of the terminal body 23 and grounded appropriately. One side of the terminal body 23 is formed with a pair of protrusions 27, 27. The protrusions 27, 27 are configured of a portion of one side of the terminal body 23 remaining after being notched longitudinally and provide an insertion connection end 25. These protrusions 27, 27 also assume an arcuate form like the outer profile of the terminal body 23, and have the forward ends thereof formed with sharp insertion blades 28, 28, respectively. As a result, the insertion connection end 25 is adapted to be inserted between the outer insulating cover 19 and the braided wire 18 of the shielded cable 15.

Also, the low-melting-point coupling material 20 of a conductive material is coated on the opposed inner surfaces of the protrusions 27, 27. The low-melting-point coupling material 20 of a conductive material is coated on the insertion connection end 25 by plating or the like using a low-melting-point brazing material such as solder.

Figure 6:
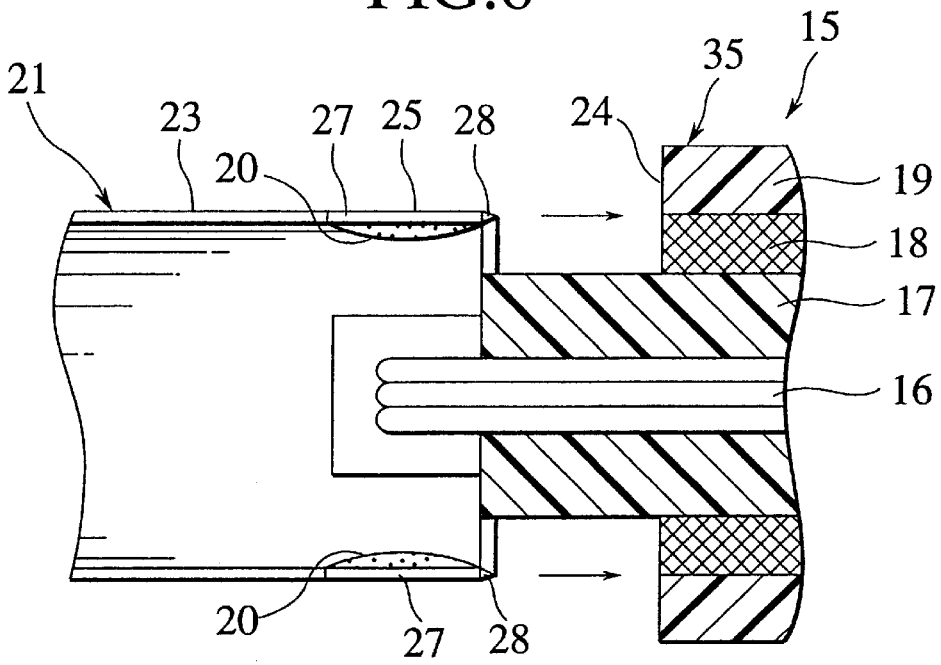
FIG. 6 is a sectional view showing the manner in which one side of the shielded terminal is inserted between the outer insulating cover and the braided wire at an end portion of the shielded cable according to the first embodiment.

The insertion connection end 25 of the shielded terminal 21, as shown in FIG. 6, is inserted between the outer insulating cover 19 and the braided wire 18 from the flush-cut surface 24 side where the outer insulating cover 19 and the braided wire 18 are cut flush with each other. As a result, the shielded terminal 21 according to this embodiment lacks the weld zone, the screwed or similar complex part for connecting or fixing to the shielded cable 15, but is so simple in structure that one side of the cylindrical terminal body 23 is only notched longitudinally. Also, as a result of inserting the insertion connection end 25 between the outer insulating cover 19 and the braided wire 18, the low-melting-point coupling material 20 coated on the insertion connection end 25 is located between the braided wire 18 and the protrusions 27, 27.

Figure 7:
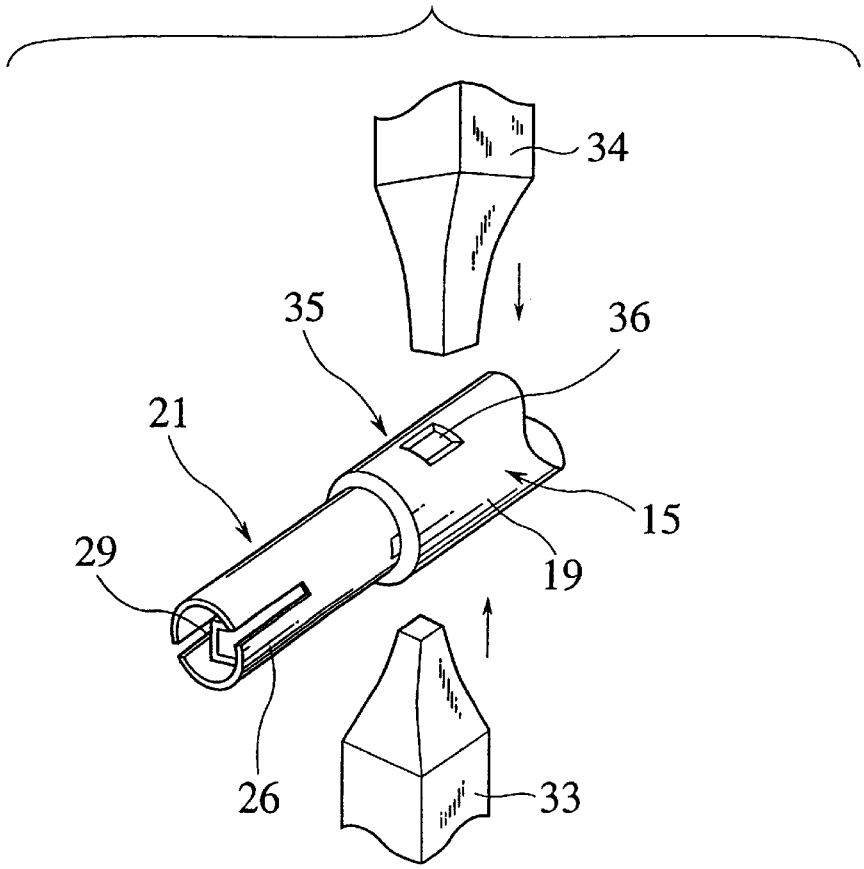
FIG. 7 is a perspective view showing the manner in which ultrasonic vibrations are applied according to the first embodiment.

Further, in the state where the insertion connection end 25 of the shielded terminal 21 is inserted between the outer insulating cover 19 and the braided wire 18 from the flush-cut surface 24 side, as shown in FIG. 7, a terminal fitting 29 connected to the end of the core 16 of the shielded cable 15 is accommodated in the terminal body 23. This terminal fitting 29 includes a holder 30 for holding the core 16 in cooperation with the inner insulating cover 17 of the shielded cable 15, a fastening connector 31 for fastening and connecting the core 16 and a contactor 32 adapted to contact the mating terminal.

Figure 5:
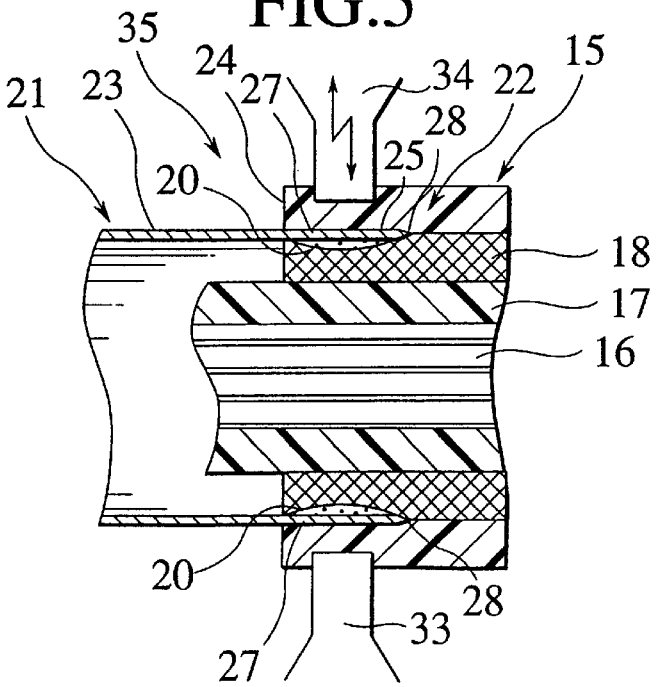
FIG. 5 is a sectional view of a shield conductor at an end portion of the shielded cable according to the first embodiment of the invention.

As shown in FIG. 5, ultrasonic vibrations are applied by an ultrasonic hone 34 to a terminal portion 35 of the shielded cable 15 held between an anvil 33 and the ultrasonic hone 34. As a result, the low-melting-point coupling material 20 is molten, and the insertion connection end 25 of the shielded terminal 21 is connected metallurgically with the braided wire 18 thereby to form a shielded conductor 22.

Next, a method of processing a shielded cable according to this embodiment will be explained.

First, as shown in FIG. 6, the core 16 is exposed together with the inner insulating cover 17. Further, the inner insulating cover 17 is stripped off to expose only the forward end of the core 16. Under this state, the outer insulating cover 19 and the braided wire 18 are cut off flush with each other thereby to form a flush-cut surface 24. From this state, the terminal fitting 29 is connected by being fastened to the core 16 and the inner insulating cover 17.

Figure 1:
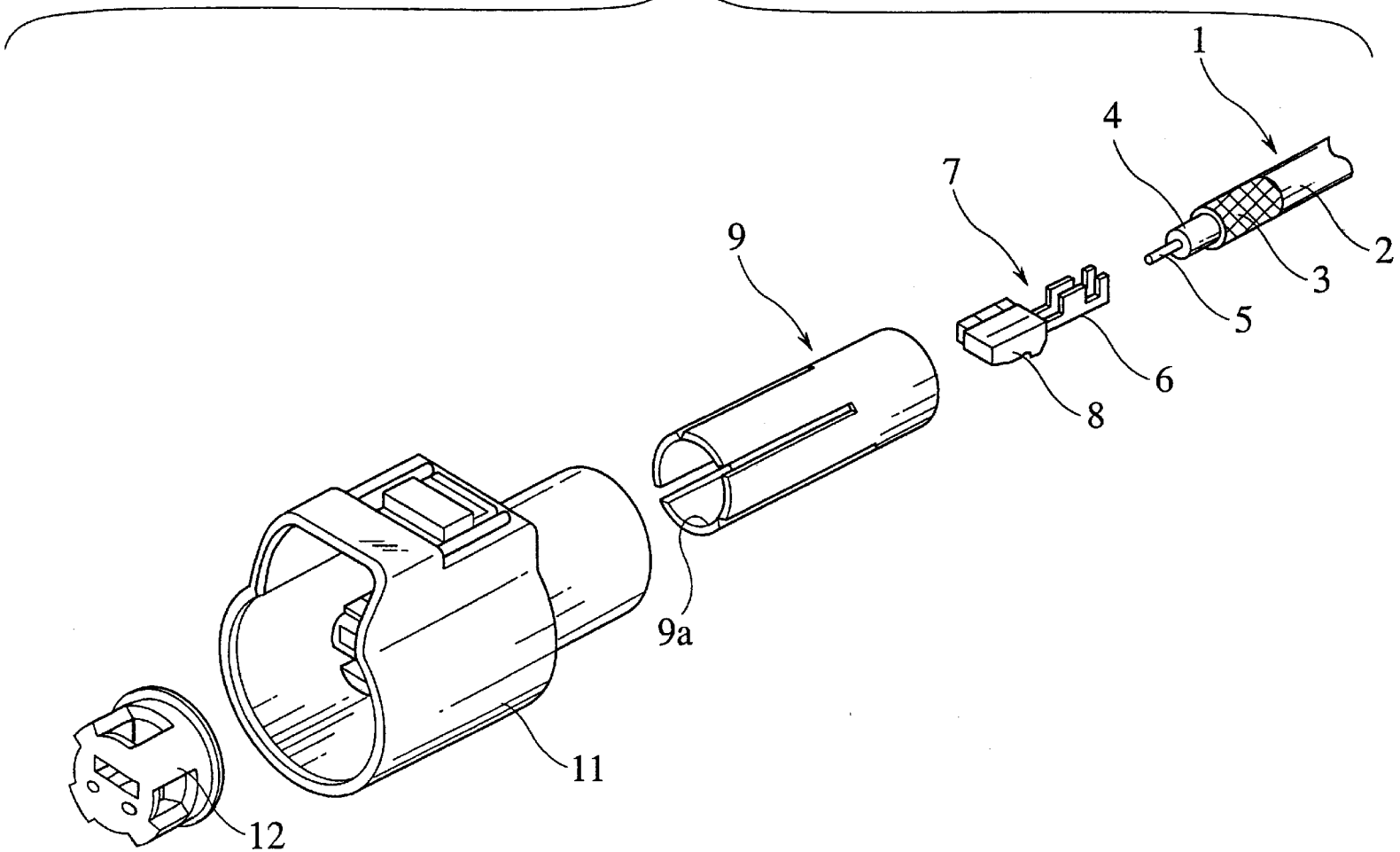
FIG.1 PRIOR ART
FIG. 1 is an exploded perspective view of a conventional connection structure of a shielded cable.
Figure 2:
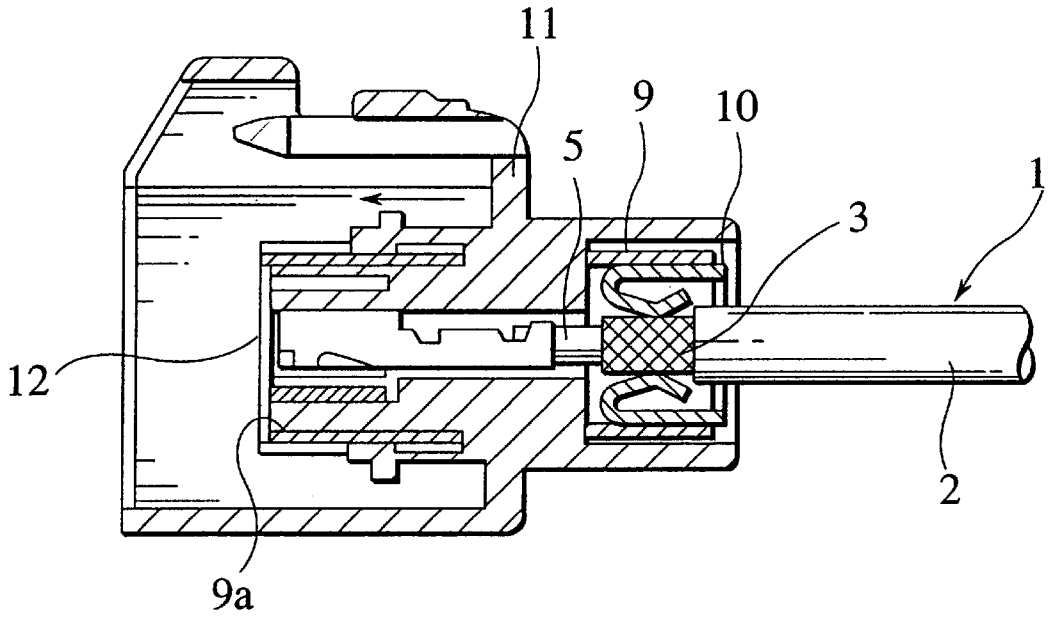
FIG.2 PRIOR ART
FIG. 2 is a sectional view showing the connected state of the conventional connection structure of a shielded cable.
Figure 3:
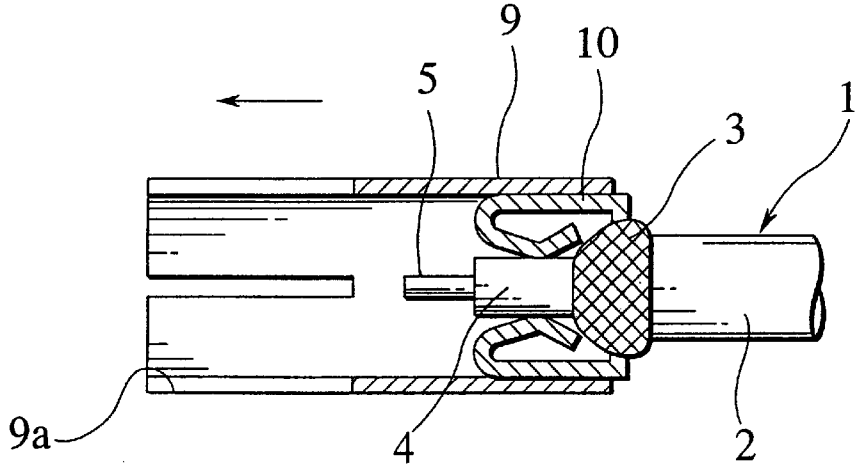
FIG.3 PRIOR ART
FIG. 3 is a sectional view for explaining a disadvantage of the conventional connection structure.
Figure 4A:
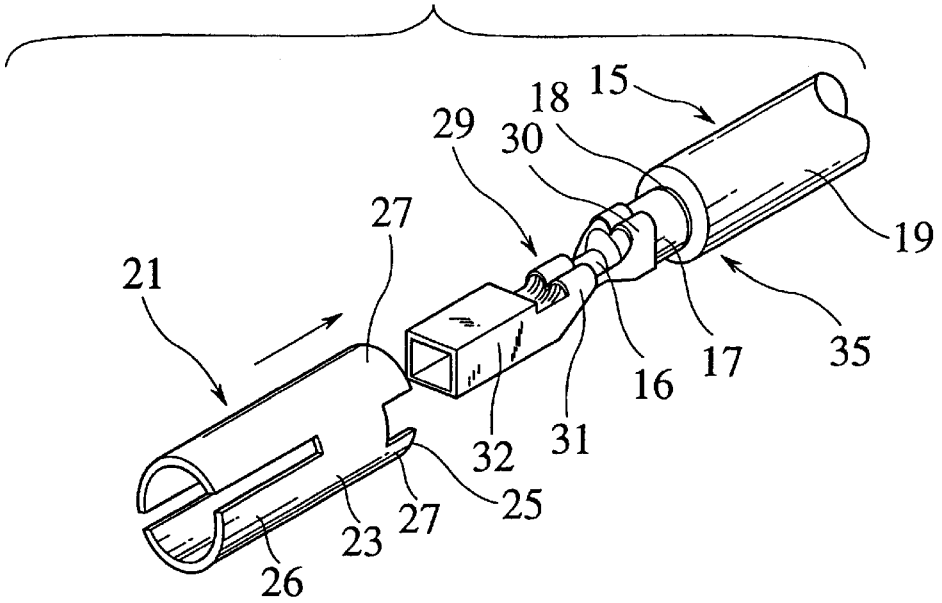
FIG. 4A is an exploded perspective view of a shielded cable and a shielded terminal according to a first embodiment of the invention.
Figure 4B:
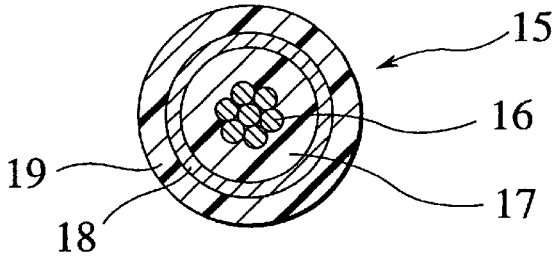
FIG. 4B is a sectional view of the shielded wire and the shielded terminal of FIG. 4A.

Then, the terminal fitting 29 is inserted into the terminal body 23 at the insertion connection end 25 of the shielded terminal 21, and as shown in FIG. 2, the insertion connection end 25 is inserted between the outer insulating cover 19 and the braided wire 18. Under this condition, the insertion connection end 2 and the braided wire 18 are in contact with each other through the low-melting-point coupling material 20 therebetween. As shown in FIG. 7, pressure is applied and ultrasonic vibrations are applied to the end portion 35 of the shielded cable 15 held between the anvil 33 and the ultrasonic hone 34. The ultrasonic vibrations generates internal heat due to ultrasonic energy and melts the low-melting-point coupling material 20. The low-melting-point coupling material 20 thus molten makes its way into the spaces between the meshes of the braided wire 18 while at the same time expanding over the surface of the insertion connection end 15 opposed to the braided wire 18, thus coupling the insertion connection end 25 and the braided wire 18 metallurgically to each other. As a result, the shield conductor 22 is formed with the insertion connection end 25 and the braided wire 18 conductively connected to each other.

In FIG. 7, numeral 36 designates a dent formed by the ultrasonic hone 34 and the anvil 33 pressuring and contacting the outer insulating cover 10.

The connection structure and the processing method according to this embodiment eliminates the need of the work of stripping off the outer insulating cover 19 for exposing the braided wire 18. Instead, the insertion connection end 25 of the shielded terminal 21 is inserted between the outer insulating cover 19 and the braided wire 18, and subjected to ultrasonic vibrations. The low-melting-point coupling material 20 coated on the insertion connection end 25 is molten thereby to metallurgically couple the insertion connection end 25 and the braided wire 18 to each other. Thus, the shielded terminal 21 and the braided wire 18 can be processed and connected to each other with rapidity and ease.

Also, in the connection structure according to this embodiment, the insertion connection end 25 and the braided wire 18 are connected to each other with the low-melting-point coupling material 20 molten by the internal heat generated by ultrasonic energy. Therefore, the coupling is not a mechanical one, but a highly reliable electrical connection is secured by the fusion of the low-melting-point coupling material 20.

Further, since the stripping work for exposing the braided wire 18 is eliminated, the number of processes for connection work is reduced while at the same time improving the connection workability.

Furthermore, the shielded terminal 21 is so shaped as to be insertable between the outer insulating cover 19 and the braided wire 18 of the shielded cable 15, i.e. the insertion connection end 25 is formed by notching one side of the cylindrical terminal body 23 longitudinally. Thus, the structure is simplified.

Also, the end of the shielded cable 15 is processed in such a simplified manner that the braided wire 18 and the outer insulating cover 19 are cut off with a section flush with each other, and the core 16 and the outer insulating cover 17 are exposed. Therefore, the terminal can be processed easily and rapidly.

The insertion connection end 25 on one side of the shielded terminal 21 can be inserted between the inner insulating cover 17 and the braided wire 18 instead of between the outer insulating cover 19 and the braided wire 18 unlike in this embodiment. In such a case, a highly reliable electrical connection is established by the fusion of the low-melting-point conductive coupling material 20 coated on the outer surface of the insertion connection end 25.

Also, in view of the fact that the stripping work for exposing the braided wire 18 is not required, the braided wire 18 of the shielded cable 15 and the shielded terminal 21 can be easily connected to each other, with the result that the number of steps of work is reduced and the workability improved.

Further, since the shielded terminal 21 can be so shaped as to be insertable between the outer insulating cover 19 and the braided wire 18 of the shielded cable 15, a simple structure results.

Now, a modification of this embodiment will be explained.

This modification provides an example for preventing the dent 36 from being formed in the outer insulating cover 19.

Figure 8:
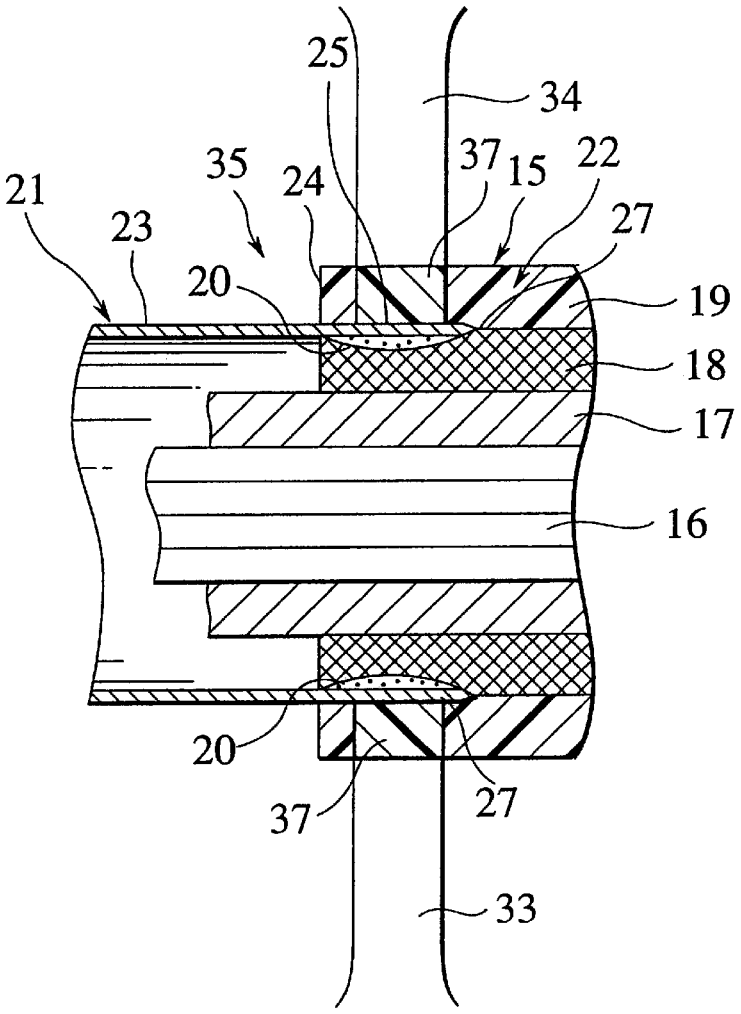
FIG. 8 is a sectional view showing the manner in which ultrasonic vibrations are applied through a resin chip according to a modification of the first embodiment.

As shown in FIG. 8, the insertion connection end 25 of the shielded terminal 21 is inserted between the outer insulating cover 19 and the braided wire 18, and the end portion 35 of the shielded cable 15 is held between the anvil 33 and the ultrasonic hone 34. In the process, resin chips 37, 37 are held between the outer insulating cover 19 and the anvil 33 and between the outer insulating cover 19 and the ultrasonic hone 34. Under this condition, ultrasonic vibrations are applied.

Ultrasonic vibrations applied while pressuring the end portion 35 of the shielded cable 15 through the resin chips 37, 37 generates internal heat due to ultrasonic energy. This internal heat melts the low-melting-point coupling material 20 and metallurgically couples the insertion connection end 25 and the braided wire 18 to each other. At the same time, the outer insulating cover 19 is molten so that the resin chips 37, 37 are embedded in the outer insulating cover 19 while at the same time the outer insulating cover 19 and the resin chips 37, 37 are molten and fusion-welded to each other at the contact portions thereof.

Figure 9:
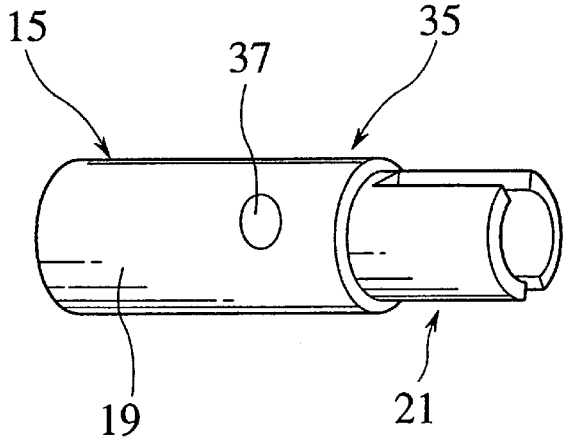
FIG. 9 is a perspective view showing an end portion of the shielded cable subjected to ultrasonic vibrations through at least a resin chip according to a modification of the first embodiment.

As a result, as shown in FIG. 9, the outer insulating cover 19 is not dented, and therefore the end portion of the shielded cable 15 develops no unevenness. The outer appearance of the end portion of the shielded cable 15 thus is improved.

The resin chip 37, which is harder to melt than the outer insulating cover 19, is made of acrylic resin, ABS (acrylonitril-butadiene-styrene copolymer) resin, PC (polycarbonate) resin, PE (polyethylene) resin, PEI (polyether imide) resin, or PBT (polybutylene terephthalate) resin, and is generally hard as compared with the vinyl chloride used for the outer insulating cover 19. All of these resins have been found proper for practical applications in respect of conductivity and conduction stability. Judgment including the appearance and insulation characteristics, however, indicates that PEI resin and PBT resin are especially suitable.

Other embodiments will be explained. Like members are designated by like reference characters.

Second embodiment

Now, an explanation will be given of the connection structure and the method of processing a shielded cable according to the second embodiment shown in FIGS. 10, 11, 12A, 12B, 12C, 13. The first embodiment described above concerns the case in which the invention is applied to a connection structure and a method of processing the end portion 35 of the shielded cable 15. The second embodiment, on the other hand, represents a case in which the invention is applied to other than the end portion, i.e. the intermediate portion in axial (longitudinal) direction of the shielded cable 15.

As shown in FIGS. 10, 12A, 12B, 12C, a shielded cable 38 used in this embodiment is formed with a slit 39 along the circumference of the outer insulating cover 19 at a position somewhat spaced from the end portion thereof. This slit 39 is formed through the outer insulating cover 19 to reach the braided wire 18. One side of the shielded terminal 40 is inserted by way of this slit 39 between the braided wire 18 and the outer insulating cover 19.

The shielded terminal 40 includes a tabular terminal body 41, an insertion connection end 42 arranged on one side of the terminal body 41 and inserted between the outer insulating cover 19 and the braided wire 18 from the slit 39 of the shielded cable 38, and a grounding terminal 43 arranged on the other side of the terminal body 41 and grounded appropriately. The insertion connection end 42 is coated with a low-melting-point conductive coupling material 20.

Figure 11:
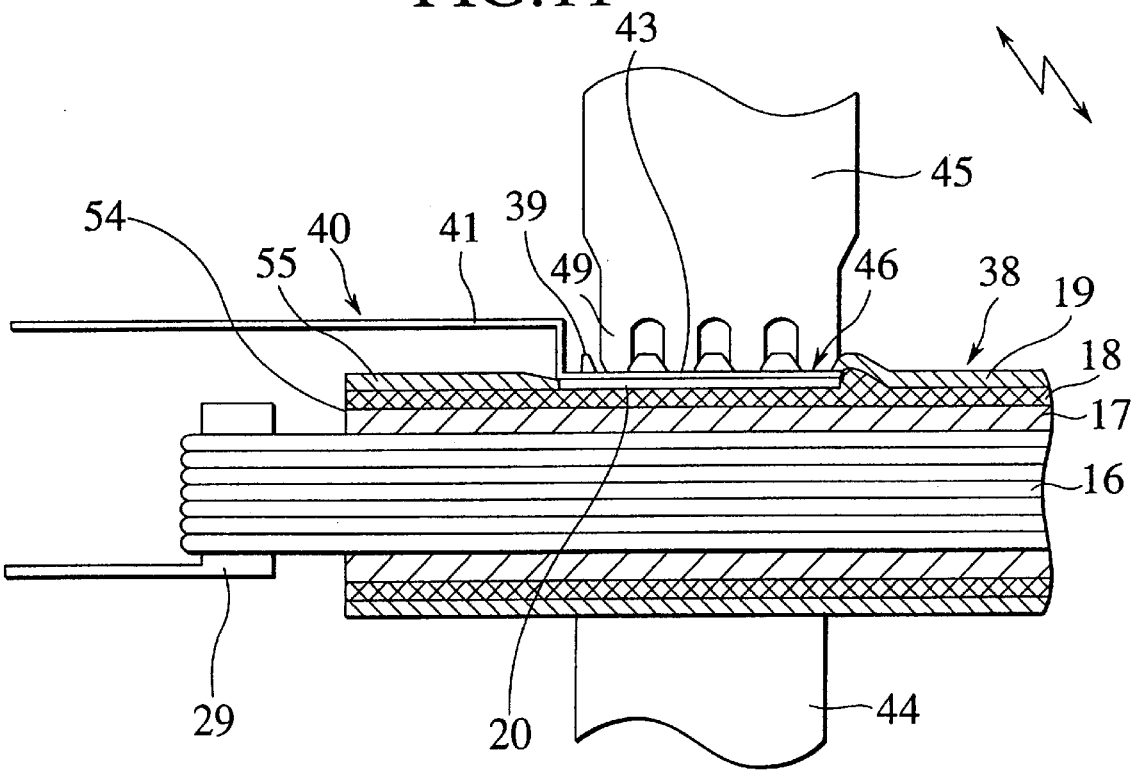
FIG. 11 is a sectional view showing the manner in which ultrasonic vibrations are conducted according to the second embodiment.

The insertion connection end 42 is inserted between the outer insulating cover 19 and the braided wire 18 by way of the slit 39, and as shown in FIG. 11, held between the anvil 44 and the ultrasonic hone 45 under pressure while causing ultrasonic vibrations by the ultrasonic hone 45. As a result, the low-melting-point coupling material 20 is molten and connects the insertion connection end 42 to the braided wire 18 metallurgically, thereby forming a shield conductor 46.

The ultrasonic hone 45 causing ultrasonic vibrations has an out-of-contact central portion 48 of the surface 47 thereof in spaced opposed relation with the outer insulating cover 19. Specifically, the surface of the ultrasonic hone 45 in contact with the outer insulating cover 19 is formed with eight protrusions 49 in two lines of four. The internal area defined by the protrusions 49 constitutes the out-of-contact portion 48. This out-of-contact portion 48, as shown in FIG. 12B, never comes into contact with the outer insulating cover 19 and therefore is not involved in ultrasonic vibrations.

Figure 10:
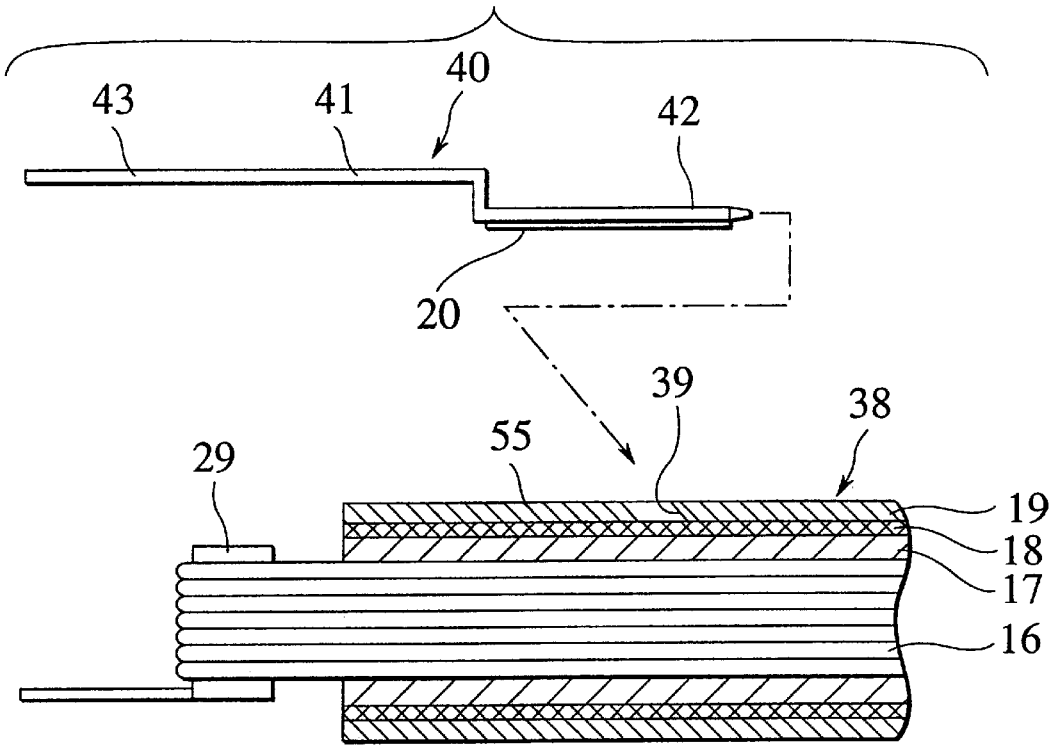
FIG. 10 is a sectional view showing a shielded cable and a shielded terminal according to a second embodiment.

Now, an explanation will be given of a method of processing a connection structure according to this embodiment. As shown in FIGS. 10 and 12A, a slit 39 is formed at a position of the shielded terminal 40 somewhat distant from the end portion thereof. By way of this slit 39, the insertion connection end 42 of the shielded terminal 40 is inserted between the outer insulating cover 19 and the braided wire 18. As shown in FIGS. 11 and 12B, the ultrasonic hone 45 is located above the outer insulating cover 19 with the insertion connection end 42 inserted therein and is held with the anvil 44.

Under this condition, ultrasonic vibrations are caused by the ultrasonic hone 45. The low-melting-point coupling material 20 coated on the insertion connection end 42 is molten, and expands between the insertion connection end 42 and the braided wire 18. Thus, the insertion connection end 42 and the braided wire 18 are metallurgically coupled to each other thereby to form a shielded conductor 46.

Then, as shown in FIGS. 12C and 13, a terminal fitting 29 connected by clamping to the core 16 in advance and a grounding terminal 43 of the shielded terminal 40 are inserted and accommodated in a terminal chamber 51 of a connector housing 50. Under this condition, as shown in FIG. 13, the forward end of the grounding terminal 43 of the shielded terminal 40 and a contactor 32 of the terminal fitting 29 are projected into a hood 52 arranged in the connector housing 50.

In the connection structure and the processing method according to this embodiment, like in the aforementioned embodiment, the work of stripping off the outer insulating cover 19 is not required for exposing the braided wire 18. The insertion connection end 42 of the shielded terminal 40 is inserted between the outer insulating cover 19 and the braided wire 18 by way of the slit 39, and ultrasonic vibrations are applied, so that the low-melting-point coupling material 20 coated on the insertion connection end 42 is molten. As a result, the insertion connection end 42 and the braided wire 18 are metallurgically coupled to each other. In this way, the shielded terminal 40 and the braided wire 18 can be connected with rapidity and ease.

Specifically, in the case where the braided wire of the shielded cable and the shielded terminal are conductively connected to each other by resistance welding, it is necessary to strip off the outer insulating cover into the shape of the insertion connection end of the shielded terminal. Then, the insertion connection end placed immovably on the stripped portion is heated by supplying current thereto from an electrode to melt the low-melting-point coupling material. The connection process therefore cannot be accomplished with rapidity.

In the connection structure according to this embodiment, the insertion connection end 42 and the braided wire 18 are connected by melting the low-melting-point coupling material 20 with the internal heat generated by ultrasonic energy. Therefore, a highly reliable electrical connection, not a mechanical contact, is established by the low-melting-point coupling material being molten for coupling.

Also, since the stripping work for exposing the braided wire is eliminated, the number of steps for connection is reduced and the connection workability is improved.

Further, the structure is simplified by the shielded terminal 40, which is in such a shape as to be insertable between the outer insulating cover 19 and the braided wire 18 of the shielded cable 38 by way of the slit 39, i.e. in a shape with one side of the tabular terminal body 41 extended.

Also, the end portion of the shielded cable 38 is processed in so simplified a fashion that the core 16 and the inner insulating cover 17 are exposed with the outer insulating cover 19 and the braided wire 18 having cut sections flush with each other, while only the slit 39 is formed in the outer insulating cover 19. Therefore, the terminal can be processed both easily and rapidly.

According to this embodiment, the slit 39 is formed somewhat distant from the cut end of the shielded cable 38, and one side of the shielded terminal 40 is inserted between the outer insulating cover 19 and the braided wire 18 by way of the slit 39. As a result, a portion 55 (FIGS. 11 and 13) is present extending from the slit 39 to the cut end 54 of the shielded cable 38. In the case where the shielded terminal 40 is pulled toward the longitudinal end of the shielded cable 38, for example, the portion 55 accommodates the tension and prevents the shielded terminal 40 from coming off.

Specifically, as shown in FIG. 14, if the slit 39 is formed at a portion nearer to the end of the shielded cable 38, the portion 55 would substantially disappear with the result that the shielded terminal 40 would easily come off from the slit 39.

According to the present embodiment, the provision of the out-of-contact portion 48 of the ultrasonic hone 45 opposed to the outer insulating cover 19 causes ultrasonic vibrations at the outer portions other than the central portion of the insertion connection end 42. Therefore, the low-melting-point coupling material 20 is not scattered to other than the insertion connection end 42 and thus can be efficiently molten between the insertion connection end 42 and the braided wire 18.

Now, a modification of the second embodiment shown in FIG. 15 will be explained. According to this modification, an arbitrary slit is formed in the intermediate portion along the axis (lengthwise) of the shielded cable 38, and one side of the shielded terminal 56 is inserted by way of this silt. As in the preceding embodiment, one side of the shielded terminal 56 and the braided wire 18 of the shielded cable 38 are connected to each other by a low-melting-point coupling material under ultrasonic vibrations, and grounded at an arbitrary position.

In this modification, the grounding terminal 58 of the shielded terminal 56 can be grounded at an arbitrary position without accommodating it in the connector housing 57 with the terminal fitting 29 connected to the core 16.

While preferred embodiments of the present invention have been described using specific terms, such description is for illustrative purposes, and it is to be understood that changes and vibrations may be made without departing from the spirit or scope of the following claims.

What is claimed is:

1. A connection structure for connecting a shielded terminal and a braided wire of a shielded cable including a core made of a conductor, an inner insulating cover for covering the core, the braided wire arranged around the inner insulating cover and an outer insulating cover of resin arranged around the braided wire for covering the core, the inner insulating cover and the braided wire, wherein one side of the shielded terminal coated with a low-melting-point conductive coupling material is inserted between the outer insulating cover and the braided wire or between the inner insulating cover and the braided wire, and with said one side of the shielded terminal inserted, ultrasonic vibrations are applied from above the outer insulating cover, so that the low-melting-point coupling material is molten and said one side of the shielded terminal and the braided wire are conductively connected to each other, forming a shielded conductor.

2. The connection structure according to claim 1, wherein ultrasonic vibrations are applied with at least a resin chip interposed between an ultrasonic hone for applying the ultrasonic vibrations and the outer insulating cover, the resin chip being embedded in the outer insulating cover.

3. The connection structure according to claim 1, wherein said one side of the shielded terminal is inserted between the outer insulating cover and the braided wire or between the inner insulating cover and the braided wire from a flush-cut surface of the shielded cable where the outer insulating cover and the braided wire are cut to form surfaces flush with each other.

4. The connection structure according to claim 3, wherein the shielded terminal includes a cylindrical terminal body and an insertion connection end arranged on said one side of the terminal body and adapted to be inserted in the flush-cut surface of the shielded cable, and a terminal fitting connected to the core of the shielded cable is accommodated in the terminal body of the shielded terminal with the insertion connection end inserted in the flush-cut surface.

5. The connection structure according to claim 1, wherein the outer insulating cover of the shielded cable is formed with a slit, and one side of the shielded terminal is inserted between the braided wire and the outer insulating cover by way of the slit.

6. The connection structure according to claim 5, wherein the shielded terminal includes a tabular terminal body, an insertion connection end arranged on one side of the terminal body and adapted to be inserted between the outer insulating cover and the braided wire from the slit of the shielded cable, and a grounding terminal arranged on the other side of the terminal body and grounded.

7. The connection structure according to claim 1, wherein an ultrasonic horn for causing ultrasonic vibrations has at least the central portion thereof out of contact with the opposed surface of the outer insulating cover.

8. A method of processing a shielded cable including a core made of a conductor, an inner insulating cover for covering the core, a braided wire arranged around the inner insulating cover, and an outer insulating cover arranged around the braided wire for covering the core, the inner insulating cover and the braided wire, wherein one side of a shielded terminal coated with a low-melting-point conductive coupling material is inserted between the outer insulating cover and the braided wire or between the inner insulating cover and the braided wire, and ultrasonic vibrations are applied from above the outer insulating cover so that the low-melting-point coupling material is molten to conductively connect said one side of the shielded terminal and the braided wire.

9. The method of processing a shielded cable according to claim 8, wherein at least a resin chip is arranged between an ultrasonic hone for applying ultrasonic vibrations and the outer insulating cover, and ultrasonic vibrations are applied through the resin chip while embedding the resin chip in the outer insulating cover.

10. The method of processing a shielded cable according to claim 8, wherein one side of the shielded terminal is inserted between the outer insulating cover and the braided wire or between the inner insulating cover and the braided wire from a flush-cut surface of the shielded cable where at least the outer insulating cover and the braided wire are cut to form surfaces flush with each other.

11. The method of processing a shielded cable according to claim 8, wherein one side of the shielded terminal is inserted between the outer insulating cover and the braided wire or between the inner insulating cover and the braided wire by way of a slit formed in the outer insulating cover.

* * * * *